US005460212A

United States Patent [19]

Darden

[11] Patent Number: 5,460,212

[45] Date of Patent: Oct. 24, 1995

[54] DEBARKING TOOL WITH CONTROLLED LOG EXITING

[76] Inventor: Walter C. Darden, 2286 Lapile Rd., Strong, Ark. 71765

[21] Appl. No.: 258,458

[22] Filed: Jun. 10, 1994

[51] Int. Cl.[6] ..... B27L 1/00

[52] U.S. Cl. ..... 144/208 E; 144/241; 144/340

[58] Field of Search ..... 144/208 R, 208 E, 144/241, 340

[56] References Cited

U.S. PATENT DOCUMENTS

| | | | |
|---|---|---|---|
| 4,122,877 | 10/1978 | Smith et al. | 144/208 E |
| 4,209,047 | 6/1980 | Weil | 144/208 E |
| 4,280,541 | 7/1981 | Reimler et al. | 144/208 E |
| 4,425,951 | 1/1984 | Pousette et al. | 144/208 E |
| 4,709,737 | 12/1987 | Jonsson | 144/241 |
| 4,852,622 | 8/1989 | Eriksson | 144/208 E |

*Primary Examiner*—W. Donald Bray

*Attorney, Agent, or Firm*—Stephen D. Carver; Trent C. Keisling

[57] ABSTRACT

An arcuate debarking tool for ring rotor debarking machines used in timber processing. The tool comprises an elongated, arcuate body having an outer end that removably mounts a cutting element, and an inner arbored end adapted to be coupled through a mandrel shaft or the like to a ring rotor. A curved, thread-like leading edge first contacts logs that are transmitted axially through the revolving apparatus, and deflects the tools radially outwardly until the log is surrounded by the revolving ring of debarking tools. A companion, spaced apart exit edge is angularly defined in the frame. It functions in a thread-like manner to slowly unengage the rotating tools from the longitudinally traveling, debarked log. The curved exiting edge threadably revolves about the log circumference and slowly transfers the only remaining contact point between the withdrawing log and the revolving tool to an inward position whereby the tool is slowly, rather than suddenly, allowed to radially retract.

17 Claims, 8 Drawing Sheets

DEBARKING TOOL WITH CONTROLLED LOG EXITING

BACKGROUND OF THE INVENTION

I. FIELD OF THE INVENTION

The present invention relates generally to debarking machines used in the timber processing industry that have a rotor that engages and feeds logs through an orifice surrounded by a plurality of arcuate debarking tools. More particularly, the present invention relates to debarking tools for ring-rotor debarking machines. Relevant prior art debarking tools and machines may be found in United States Patent Class 144 and the many subclasses listed thereunder.

II. DESCRIPTION OF THE PRIOR ART

As will be recognized by those skilled in the art, ring rotor debarking machines comprise a rotor having a plurality of arcuate, radially spaced apart debarkers disposed upon the circumference. The debarking tools arc inwardly towards the central opening of the rotor, and forcibly contact logs being drawn through the apparatus. The debarking tools extend radially inwardly from their attachment at the exterior of the rotor. The tools distally mount cutting edges that are resiliently disposed adjacent the axis of rotation of the rotor.

When the rotor is rotated and a log enters the rotor inlet, the tools vigorously engage the log. Initial engagement forces the spring-loaded debarking tools to climb the log surface, opening outwardly to circumscribe the log. Radial movement of the tools disposes their cutting edges upon the exterior surface of the log where they begin debarking the log. When the log exits the rotor outlet, normal forces biasing the tools radially inwardly force them to rapidly close inwardly.

The prior art discloses several debarking tools that work in the manner discussed hereinabove. U.S. Pat. No. 4,280,541, issued Jul. 28, 1981, to Reimler et. al., teaches an invention that climbs up logs with irregular ends. U.S. Pat. No. 3,973,607, issued Aug. 10, 1976 to Jonsson, discloses a debarking tool that has an integrally formed arm that is chute shaped.

A design patent of interest is U.S. Pat. No. Des. 276,161, issued Oct. 30, 1984, to Valo that shows a debarking tool that has a curved leading edge. U.S. Pat. No. 2,911,020, issued Nov. 3, 1959, to Wennberg, shows a debarking tool that has an elongated arcuate bark deflecting wing on the leading edge of the tool. U.S. Pat. No. 4,653,559, issued Mar. 31, 1987, to Ackerman discloses a forwardly-projecting debarking tool debarker arm that is located ahead of the leading face of the barker arm.

Several other inventions of general relevance are U.S. Pat. Nos. 4,657,056; 4,506,713; 4,516,513; 4,653,561; 4,852,622; 5,193,597 and 5,263,522. These inventions deal with other aspects of the debarking machine.

However, the prior art fails to accommodate the stress resulting from the rapid inward movement the debarking tools undergo when the log exits the outlet. This movement often causes breakage or weakening of the tools when they contract too rapidly. Therefore, it is desirable to provide a debarking tool that climbs down the log in the same manner as the prior art tools climb up the log. Another problem with the prior art is that logs sometimes back up into the exit end of the rotary head. Unless provisions are made for this phenomena, damage can occur.

SUMMARY OF THE INVENTION

I have designed a radial debarking tool for ring-rotor debarking machines that is especially adapted to gradually disengage from the log as it exits the rotor.

My debarking tool preferably comprises a pair of spaced apart, non-parallel arcuate cutting edges that cooperate to debark the log in an efficient, non-destructive manner. An initial cutting edge first engages the log as the log is mechanically, axially drawn into the rotor head. At this time the rotor concurrently revolves about the log. At the center of the machine is a processing orifice circumscribed by the debarker tools.

As each log first contacts the rotating head, the debarkers are radially deflected outwardly to admit the log into the orifice. Rotation of the rotor allows the arcuate front edge of each debarker tool to contact the log and begin climbing the log exterior to properly align its cutting head. Continued rotation vigorously strips the periphery of the log in response to contact with the cutting tips on multiple cutting heads. When the log has been debarked and exits the outlet, the rear, arcuate exit edge of my debarker tool climbs down the surface of the log, thus controlling the debarkers during log exiting. This phenomena allows all the tools to radially deflect inwardly to a desired resting position in a controlled, non-destructive manner.

Thus a primary object of the present invention is to provide a sturdy and reliable log debarking arm for ring rotor debarking machines.

Another object is to provide a log debarking arm of the character described with a special log exiting edge enabling gentle closing and operation of all the cooperative debarking arms as logs emerge from the apparatus.

Another object is to provide a rigid log debarking arm of the character described adapted to be non-destructively employed with rotation ring type debarking machines.

Another object is to provide a swinging debarking arm for ring rotor debarking machines that will close in a gentle fashion without snapping or ringing or banging or making loud noises.

An important object is to provide a debarking system in which the radial debarkers automatically and safely retract as debarked logs exit the rotor.

Another object is to provide a log debarking arm of the character described which is detachably mounted to a ring type debarking machine and which includes means for contacting exiting logs after the cutting tip portions have ceased cutting.

Another object is to provide a log debarking arm of the character described which utilizes unique construction to prevent body fracturing.

Another object is to provide for reliable and clean debarking within rotary ring type debarking machines.

Yet another object is to provide a system of the character described that will not be damaged when previously debarked logs travel back into the system.

Another purpose is to reduce noise typically generated through the operation of rotary ring type debarking machines.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
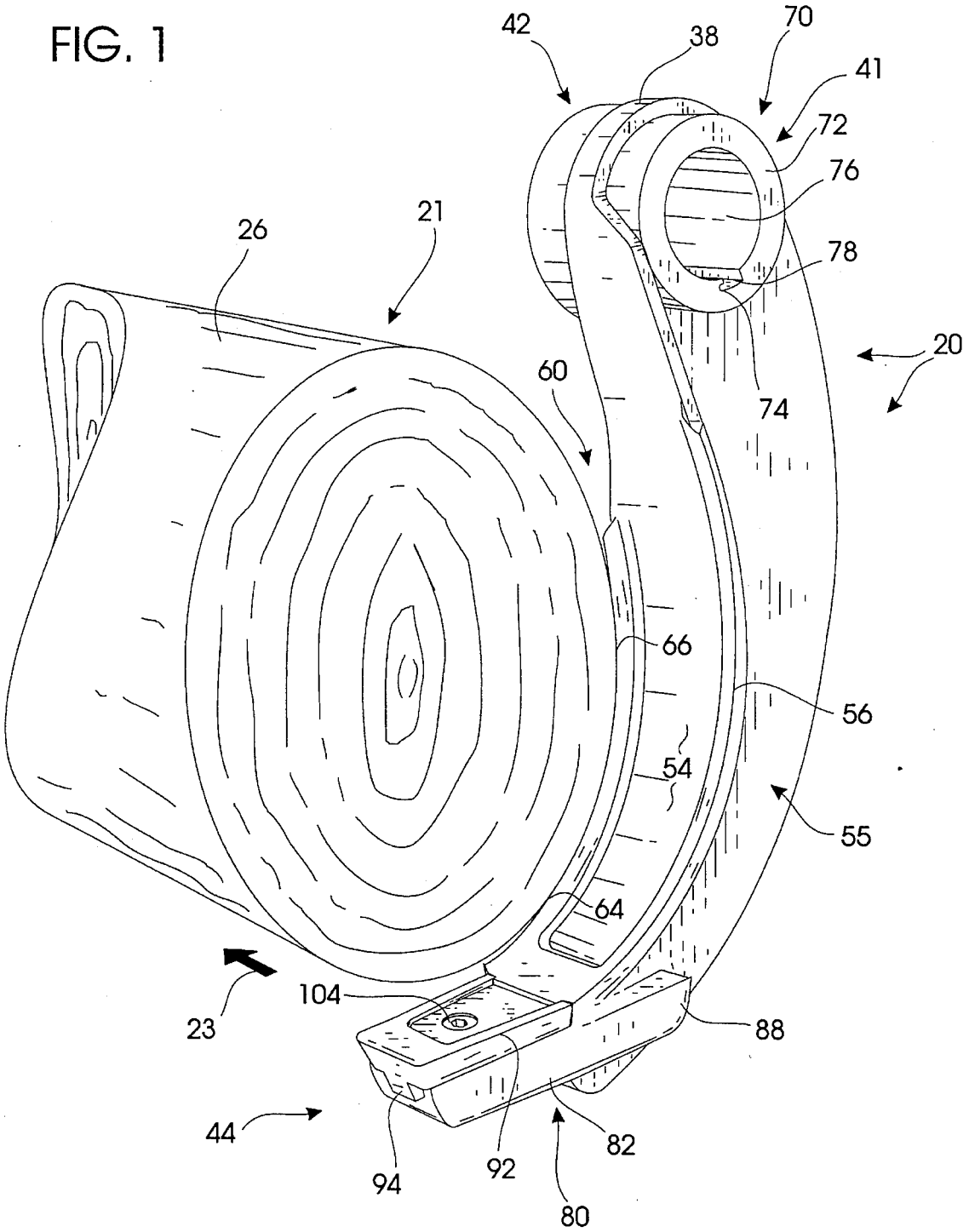
FIG. 1 is a fragmentary, front left side, perspective, environmental view of the best mode of my debarking tool showing a debarked log exiting the tool, with pieces thereof omitted for clarity

Referring more specifically to the drawings, my improved self-exiting debarking tool thereshown is broadly designated by the reference numeral 20. Tool 20 is used with ring-rotor debarking machines, either as a replacement for prior art debarker arms or as original equipment with new machines. A plurality of tools 20 is deployed in a circular array on a revolving rotor that surrounds a log 21 moving axially in a direction indicated by arrow 23 (FIG. 1).

Preferably the tool 20 comprises a rigid, arcuate frame 40 comprising a shaft-receptive arbor 41 adapted to be conventionally secured to a suitable mandrel shaft emanating from the ring rotor 22. As will be appreciated by those skilled in the art, several of the debarking tools 20 are mounted in a radially spaced-apart, circular relationship on the ring rotor 22 of a conventional debarking machine. The tools 20 are tensioned in a closed position until a log 21 enters the machine 30. Then the tools radially rotate open to an operating position and strip the bark 24 (FIG. 14C) from the log 21. After debarking the log, the tools 20 forcefully rotate back to a closed position (Figs. 14A–14F and 15A–15F).

Figure 2:
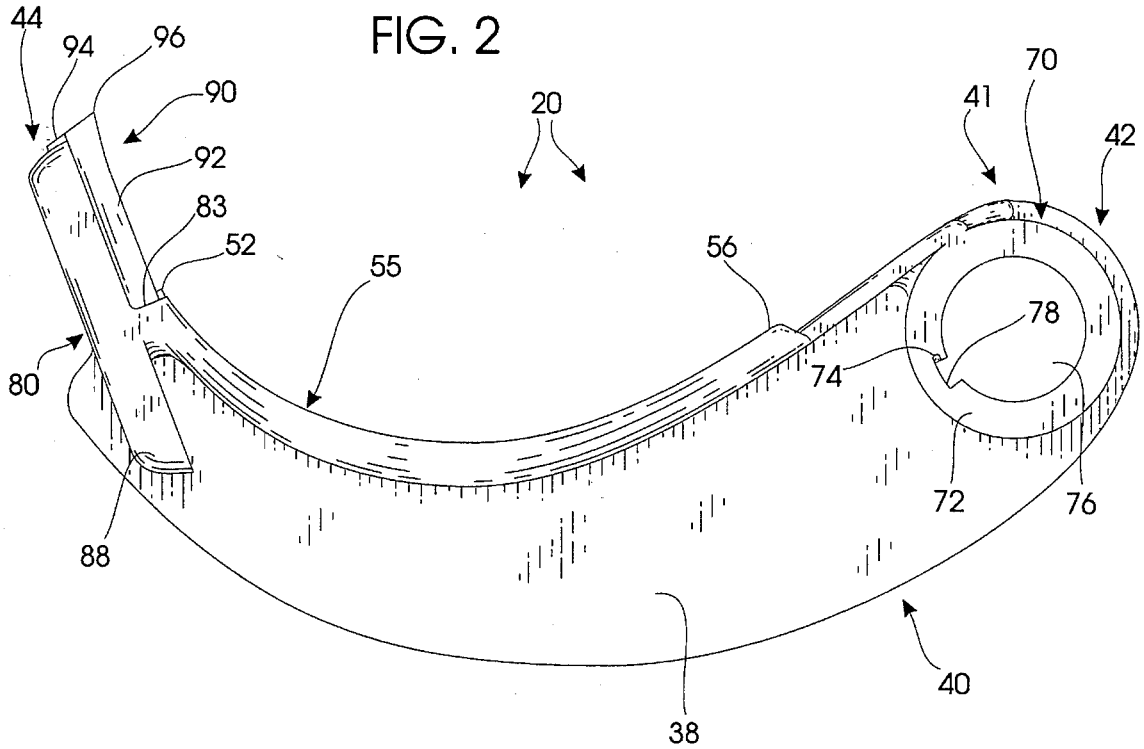
FIG. 2 is a front elevational view of the tool.
Figure 3:
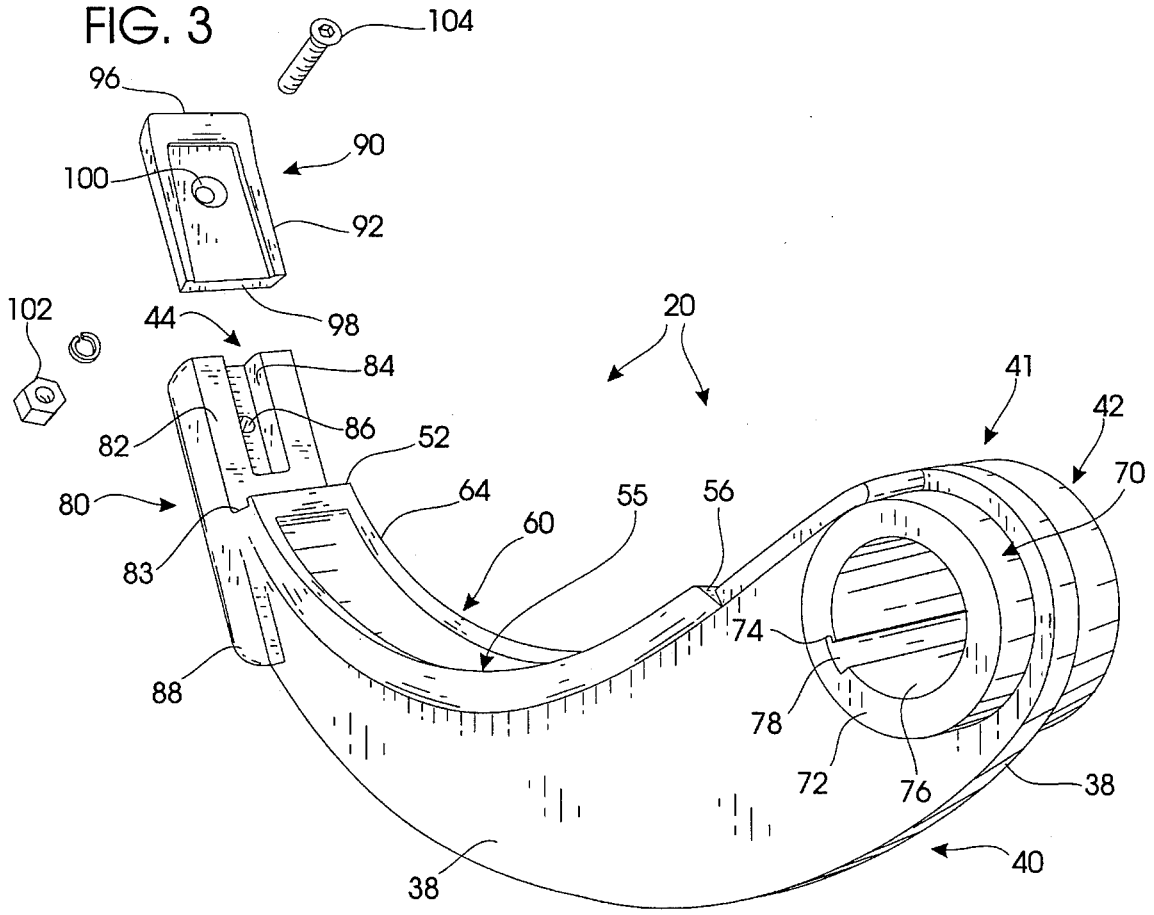
FIG. 3 is an exploded front isometric view of the tool.
Figure 4:
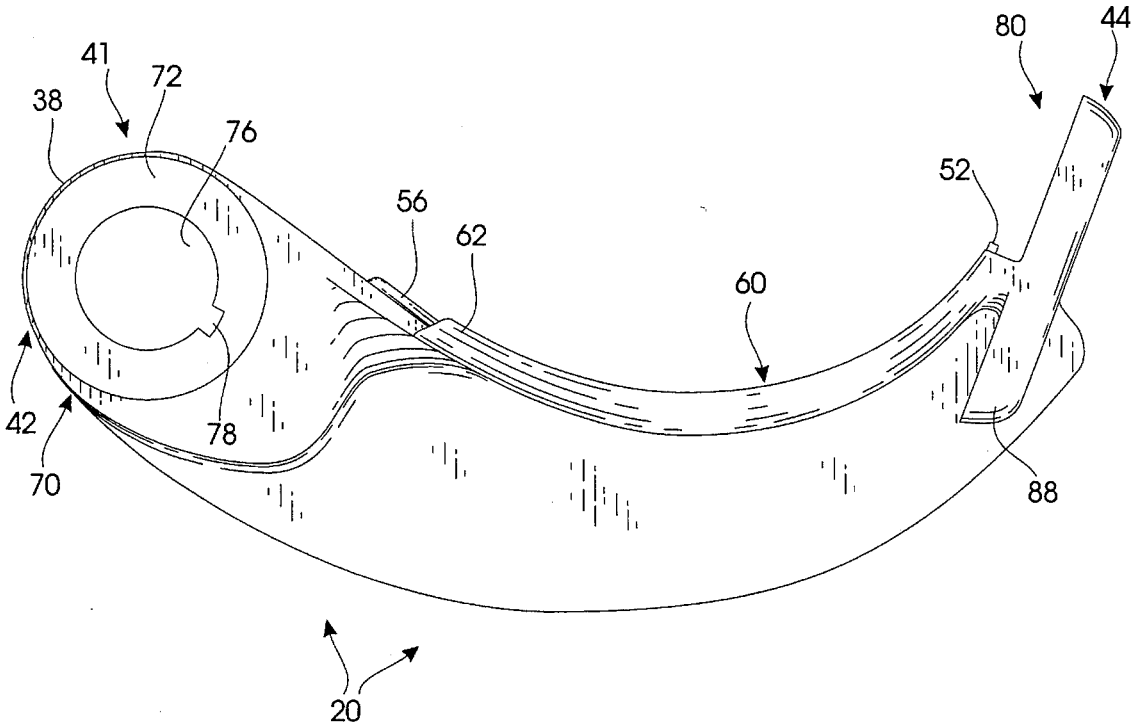
FIG. 4 is a rear elevational view of the tool.

The preferred debarking tool 20 comprises a frame 40 that has an arcuate, concave inner surface 54 atop an arcuate arm 38. The frame is integral with the arbor 41, and comprises a rigid shaft sleeve 70 at mounting end 42. The opposite cutting end 44 mounts a replaceable cutting tool or bit 90 (FIGS. 1–3). Shaft sleeve 70 vertically intersects the plane of arm 38 and is encompassed therein. Preferably, the mass of the collar 72 approximates the mass of arm 38. Channel 78 and keyway 74 are both defined in shaft housing 70 to facilitate the correct attachment of the tool 20 to the appropriate ring rotor mandrel.

Figure 5:
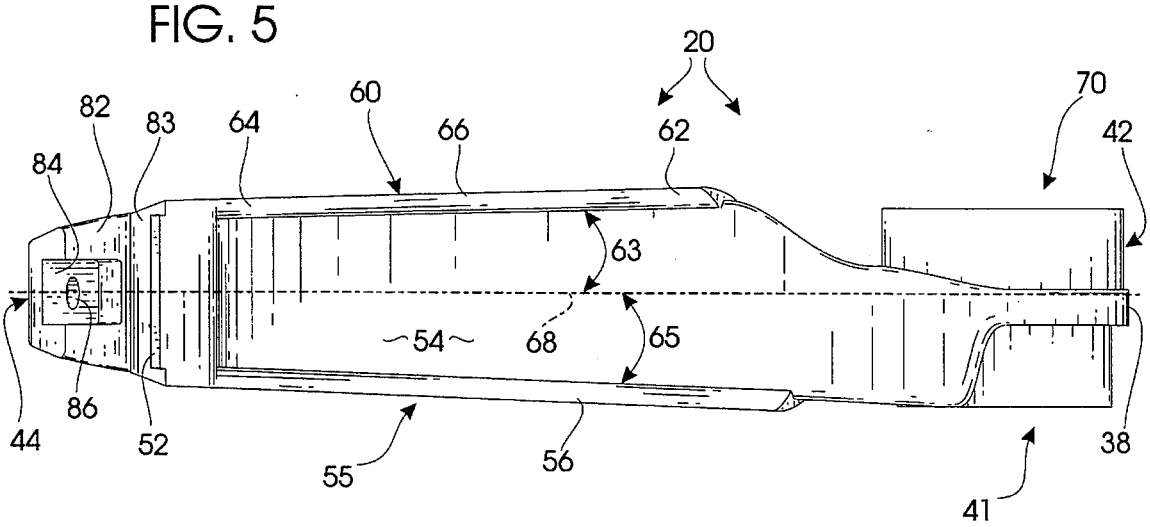
FIG. 5 is a top plan view of the tool, as viewed from a position generally above FIG. 2 and looking downwardly.
Figure 6:
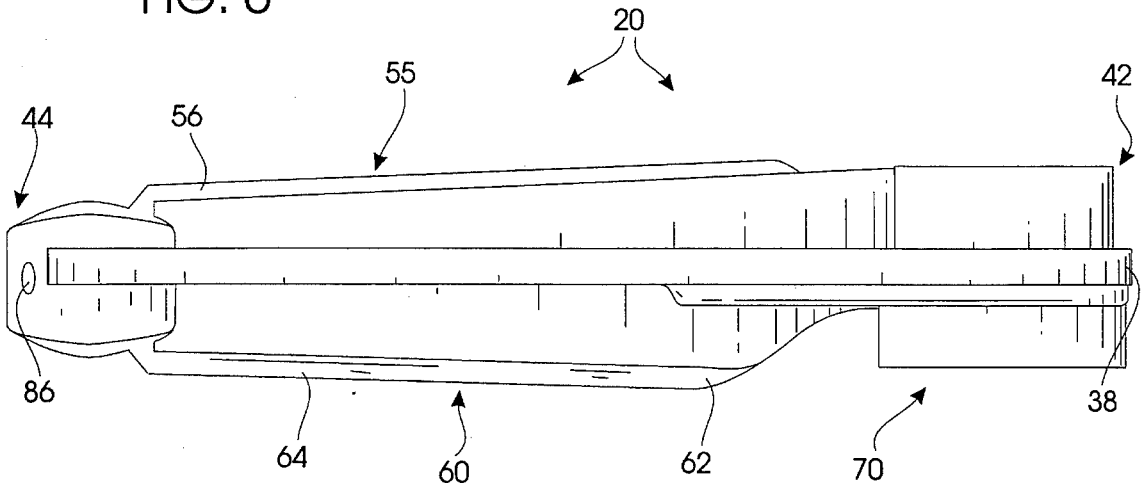
FIG. 6 is a bottom plan view of the tool.
Figure 7:
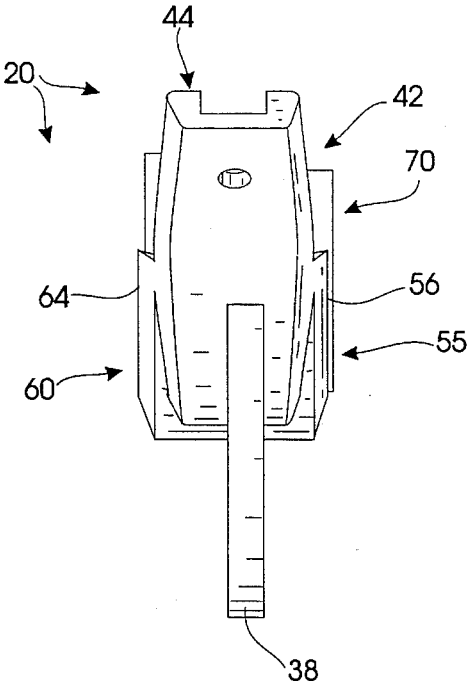
FIG. 7 is a left end elevational view of the tool.
Figure 8:
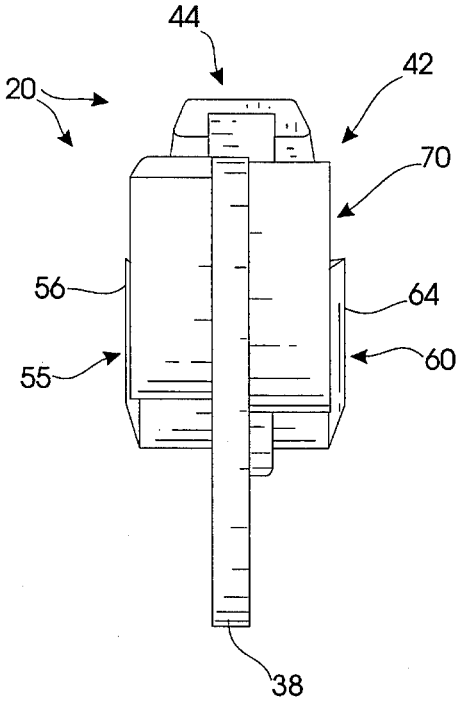
FIG. 8 is a right end elevational view of the tool.
Figure 9:
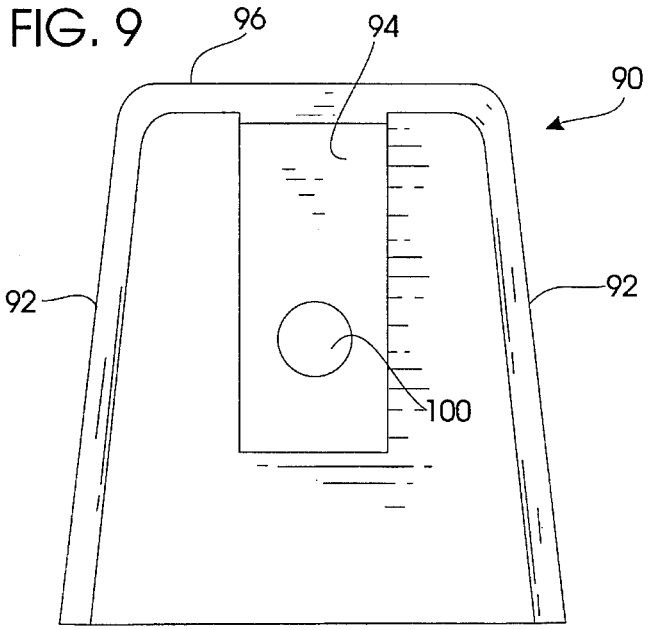
FIG. 9 is a top plan view of the preferred cutting bit.

The tool top surface 54 (FIG. 5) defines two opposed, upturned edges that facilitate the radial movement of the tool 20, depending upon log contact. The leading edge moves the arm from a closed, resting position to an open operating position. Leading edge 55 comprises an elongated arc that "climbs" a log 21 to place the cutting bit 90 in contact with the log. When the log initially impacts the tool 20, it strikes the raising edge 55 at point 56. As the log moves axially forwardly into the rotating ring rotor 22 (i.e., in the direction indicated by arrow 23), the end 56 of the raising or leading edge 55 of each tool first engages the log periphery. At this time the log thus first hits the portion of the tool furthest from the center of the input orifice.

As the leading edge 55 of each tool 20 is moved about the log, the tools begin moving radially outwardly to open the rotor 20. This radial movement forces each tool 20 to arc outwardly to place the bit 90 on the log to dislodge bark 24 (FIGS. 14A–14C and 15A–15C). While the bit 90 debarks the log 21, the frame 40 does not contact the log 21 (FIGS. 14C and 15C). The bit 90 is preferably comprised of a hard, brittle metal and it is removably attached to the tool 20.

In a preferred configuration, the bit 90 bolts into a slot 84 in the bit support 80 to ensure proper alignment (FIGS. 2 and 3). An orifice 100 penetrates the bit 90 and a corresponding orifice 86 penetrates the bit support 80 to facilitate the attachment. Bit 90 couples to tool 20 by nut 102 and bolt 104. Bolt 104 tightens flushly with the surface of orifice 100 so that debris does not impede the tool 20.

Figure 10:
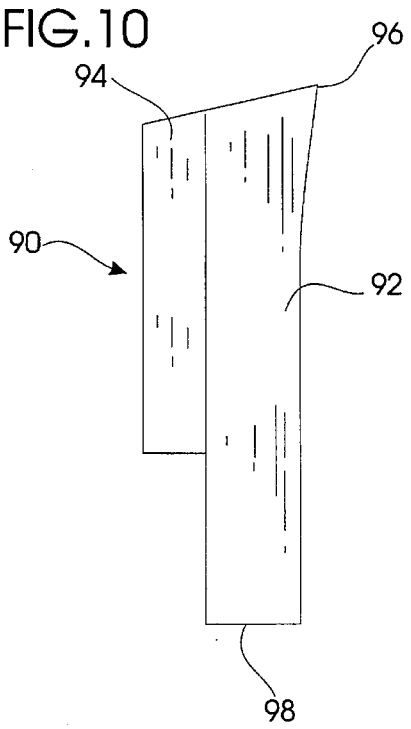
FIG.10 is a left side elevational view of the bit, the right side being a mirror image thereof.
Figure 11:
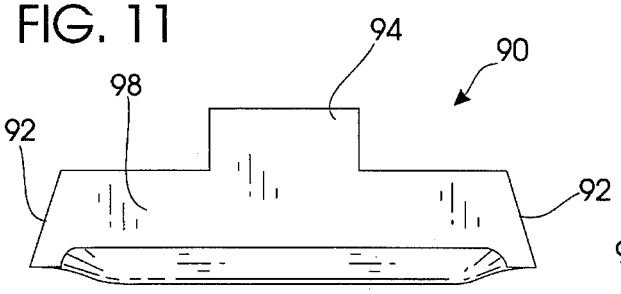
FIG. 11 is a front end elevational view of the bit.
Figure 12:
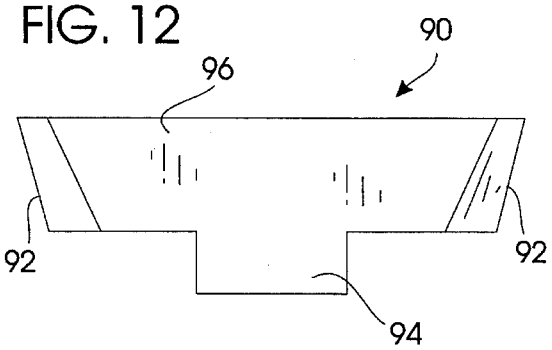
FIG. 12 is a rear end elevational view of the bit.
Figure 13:
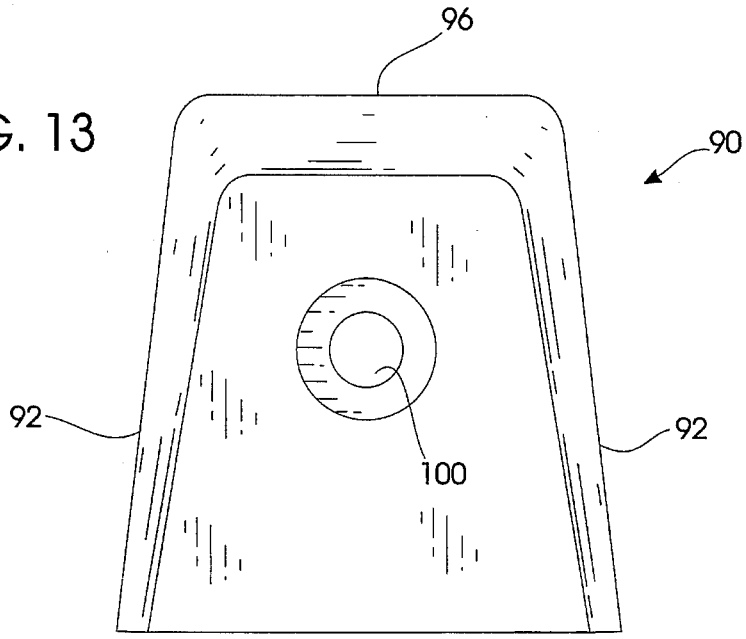
FIG. 13 is a bottom plan view of the bit.

The inner edge 98 of bit 90 inserts into a channel 83. The channel 83 is defined between the lip 52 of the surface 54 and the inner face 82 of bit support 80 and it runs perpendicularly to channel 84. Wings 88 extend into the frame 40 from the cutter support 80 for additional backing and to convey debris from the interior of the tool 20 to the exterior. The cutting edge 96 extends angularly outwardly at about seven degrees from the plane established by the inner face of sides 92 (FIGS. 3 and 10). This angular extension prolongs the useful life of the bit 90 because the tip 96 is exposed to continual wear as a result of the debarking operation and must be constantly resharpened. The primary function of sides 92 of bit 90 is to provide a smooth juncture between the lead edge 55 and the tip 96 and the exit edge 60 and the tip 96.

When the log 21 is debarked, it begins to exit the ring rotor 22. As the bit 90 leaves the debarked surface 26 of the log 21, the exit edge 60 begins to climb down the log 21. This radial movement rotates the tool 20 inwardly (FIG. 1) back toward its previous closed position (FIGS. 15C–15F).

The exit edge 60 first contacts and engages the log 21 at its end 64. As rotor rotation continues, the log moves forwardly, and contact between the log 21 and the exit edge 60 gradually moves from the end 64 to an intermediate point 66, and thereafter to point 62. The radial distance the tool 20 is from its closed position also decreases proportionately thereto.

The radial distance the tool 20 travels before the log 21 exits the ring rotor 22 depends upon the size of the individual log. The angle 63 between the longitudinal axis 68 of the tool and the exit edge 60 is greater the zero degrees; in other words the exit edge 60 is not parallel with the axis 68. It intersects the axis forming a small acute angle of approximately two to fifteen degrees. The acute angle 65 (FIG. 5) between the longitudinal axis 68 and the leading edge 55 is preferably less than angle 63. Nominally it is between two to ten degrees.

Eventually, the log 21 exits the ring rotor 22, losing contact with the exit edge 60. By this time, the radial distance remaining for the tool 20 to return to its closed position has been dramatically reduced (FIG. 15E).

OPERATION

Figure 14A:
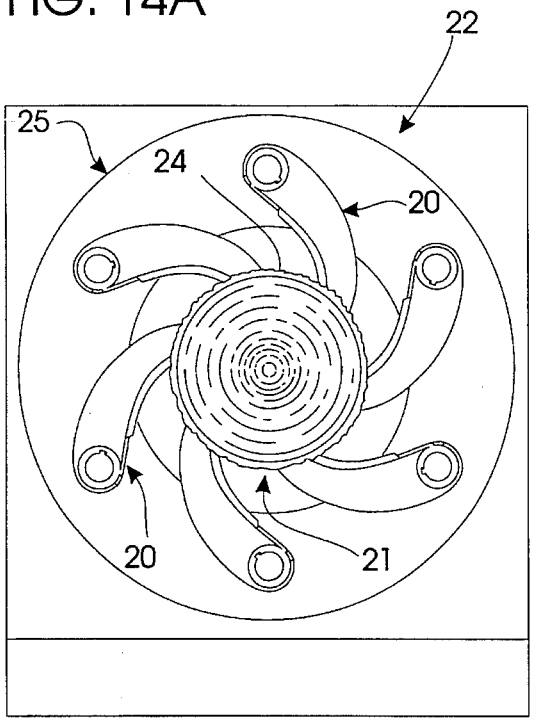
FIG. 14A is a fragmentary, front elevational view showing a log first entering a debarking machine, with portions thereof broken away or shown in section for clarity.
Figure 15A:
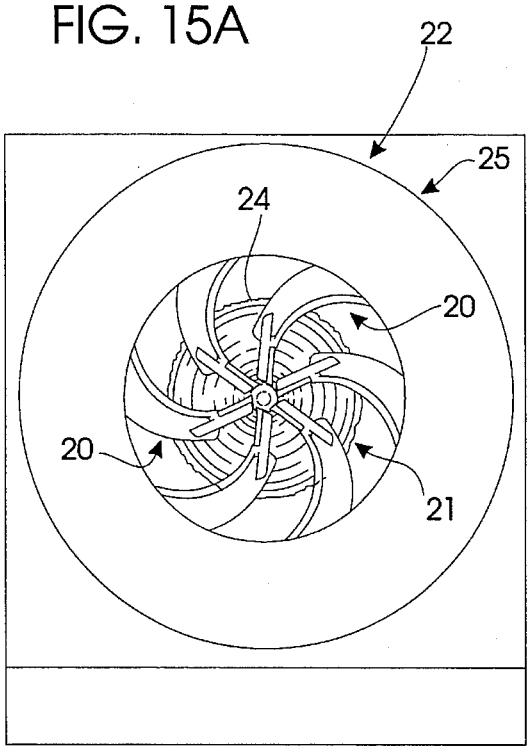
FIGS. 15A–15F are a progressive series of fragmentary, rear elevational views corresponding to FIGS. 14A–14F, but showing the structure from an opposite side of the rotor.
Figure 14B:
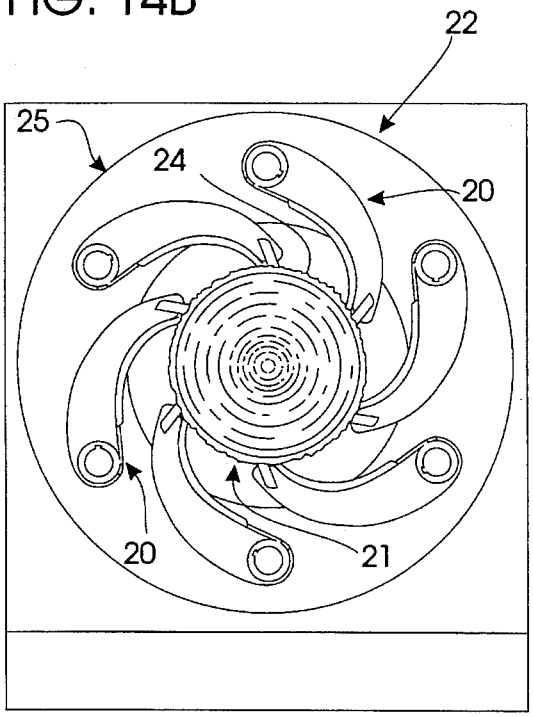
FIG. 14B is a view similar to FIG. 14A, but showing a log first deflecting the debarking tools as processing begins.
Figure 15B:
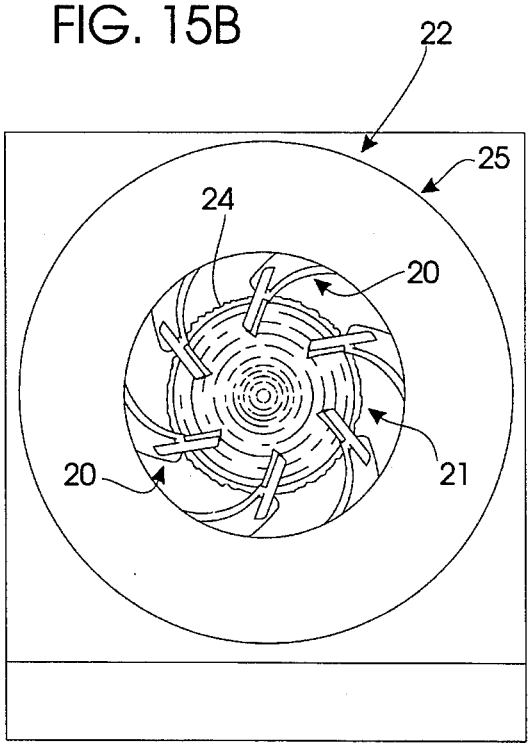
Figure 14C:
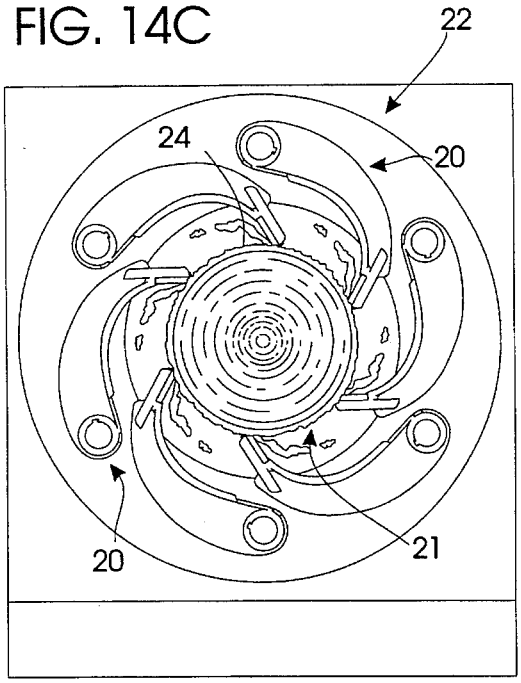
FIG. 14C is a view similar to FIGS. 14A–14B, showing a log being debarked by several of the tools.
Figure 15C:
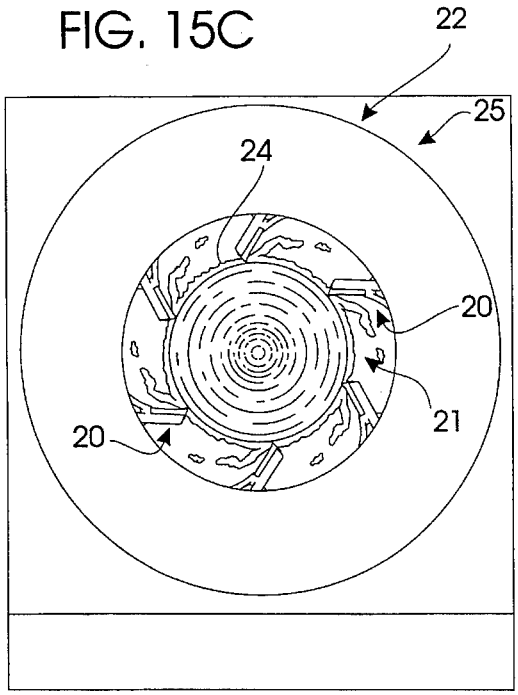

FIGS. 14A and 15A should be compared to see the entering log from the front and rear of the machine. When the axially traveling log moves within the center of rotation of the machine, it meets the edges 55 of each tool (FIGS. 14A, 15A) which jointly engage the log in thread-like fashion. Tangential engagement of the combined thread-like edges 55 results in gradual outward deflection of each tool. As the tools radially deflect outwardly (FIGS. 14B, 15B), they rotate about the center of the rotor, that is aligned generally coaxially with the log. Vigorous debarking forcefully occurs along the length of the log (FIGS. 14C, 15C) until the logs emerge from the rotor.

With conventional tools the log will eventually drop from the rotor, disengaging itself in near unison from all of the tools. After a log is "done," conventional tools quickly drop to the position illustrated in FIG. 15A where they all arc inwardly. When conventional tools last contact exiting, debarked logs, their contact is established only at their cutting end, so they are maximally radially deflected at this time. When the log drops out, all known conventional tools suddenly crash inwardly toward the center of rotation, assuming a position as indicated in FIG. 15A. The haphazard crash can damage the tools, and it contributes to unwanted noise and inefficiency.

Figure 14D:
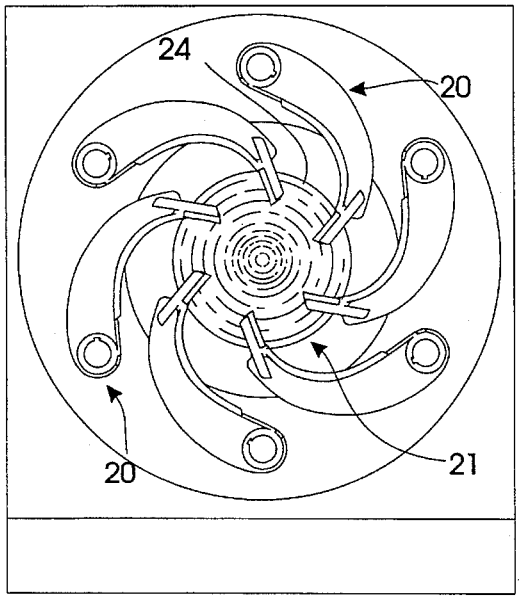
FIG. 14D is a view similar to FIGS. 14A–14C showing a debarked log exiting the debarking machine, with portions thereof broken away or shown in section for clarity.
Figure 15D:
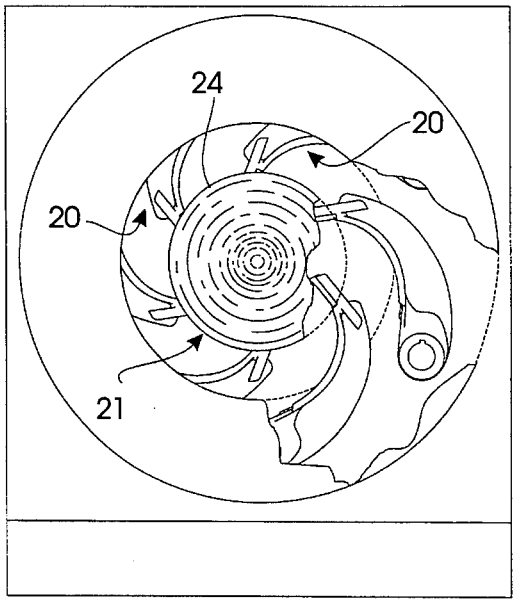
Figure 15E:
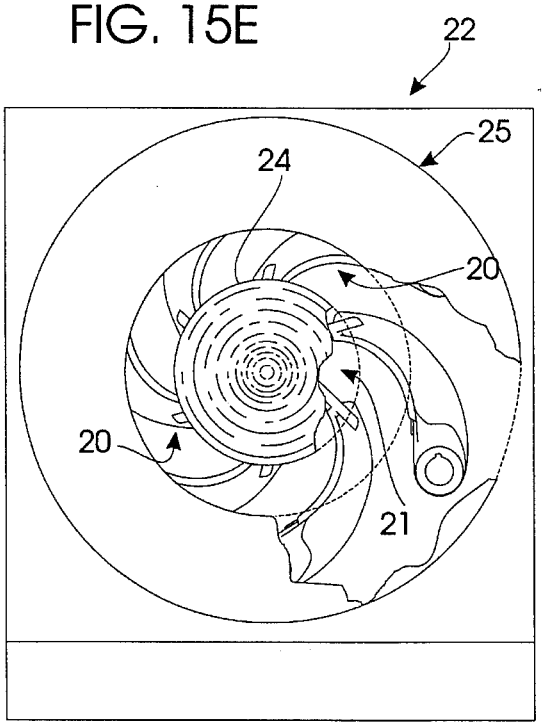

As the debarked log longitudinally travels away from the rotating array, the last portion of each tool 20 touched by the log will be raised point 62 of the exit edge 60. FIGS. 14D and 15D show where the log is withdrawing and first engaging the exit edge 60. Point 62 is disposed inwardly along the exit edge towards the arbor 41. Thus as logs axially withdraw from the apparatus, a screw action from edge 60 makes the tools "ride up" relative to the log. In other words, the tools are displaced radially and all rotated about their arbor 41 as exit edge 60 is "threaded" about the periphery of the log. Physical contact with the axially emerging log occurs with less and less of the surface of the tool.

Figure 14E:
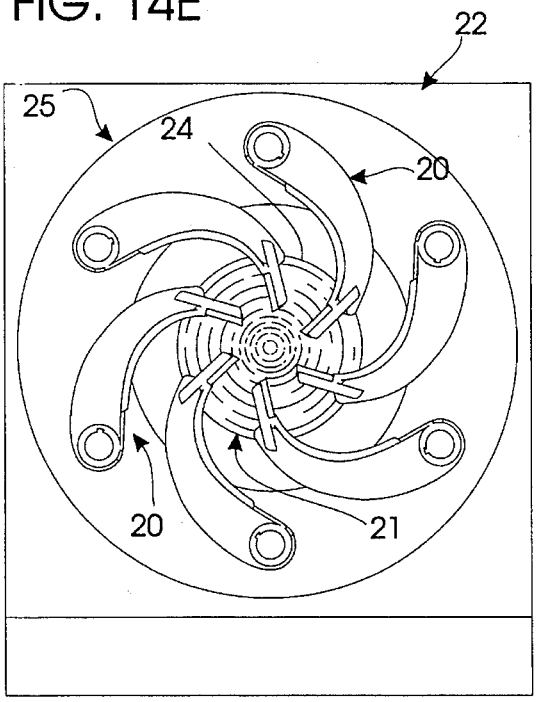
FIGURES 14E–14F are views similar to FIGS. 14A–14D but showing retraction of the debarking tools as the debarked log exits the rotor.
Figure 14F:
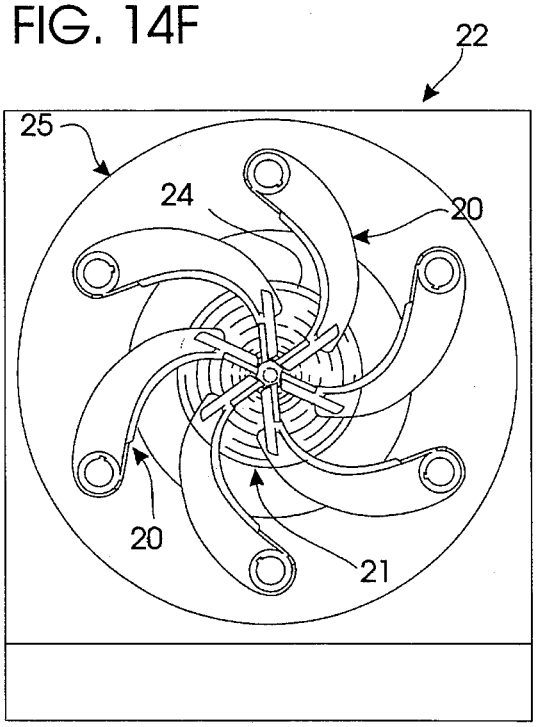
Figure 15F:
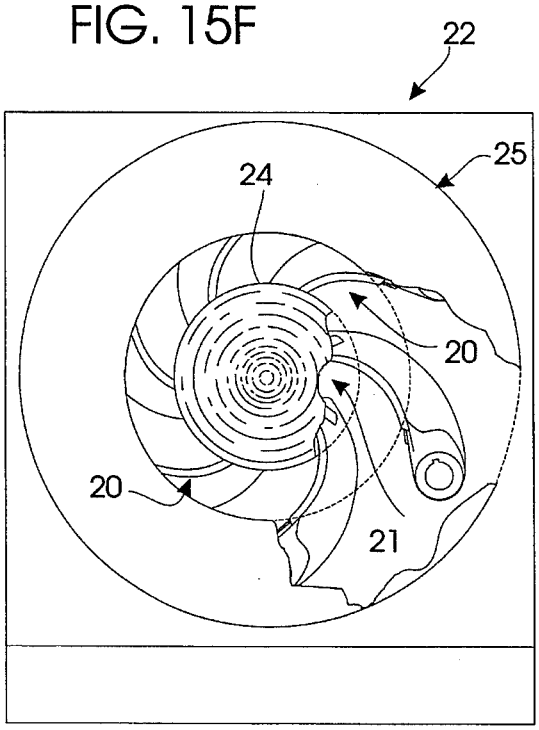

The last point to touch the withdrawing log will be point 62 of the exit edge 60, which is spaced apart angularly and linearly from the cutting tip 90. FIGS. 14E and 15E show the log exiting, allowing the tools to slowly retract due to edge 60, After total withdrawal, the position of FIGS. 14F and 15F is then reached. However, the inwardly collapsing array of tools is forced to gradually return to the position of FIG. 15A rather than suddenly. Thus sudden movement and possible tool damage and collision are avoided.

Importantly, when logs are jammed in the system, or where they otherwise move backwards into the ring center, they will not forcibly hit contracted debarkers. Instead, they will gradually hit point 62 mentioned earlier, and gently, rotatably force the debarkers to radially open.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A log debarking tool for rotary debarking machines, the tool comprising:

a rigid, generally arcuate frame adapted to be coupled to a ring rotor of said rotary debarking machine;

an arcuate leading edge defined on said frame for first contacting a log moving into said machine and moving said frame radially outwardly from the log;

replaceable cutting means disposed upon an end of said frame for contacting and debarking said log; and, a spaced apart exiting edge defined on said frame opposite said leading edge for gradually unengaging the log from said frame.

2. The log debarking tool as defined in claim 1 wherein said frame comprises a longitudinal axis, and said exiting edge defines an acute angle relative to said longitudinal axis.

3. The log debarking tool as defined in claim 2 wherein said exiting edge facilitates the gradual inward radial movement of said tool as said log exits said rotor.

4. The log debarking tool as defined in claim 3 wherein said exiting edge comprises an elongated arcuate edge adapted to climb said log to move said frame radially inward.

5. The log debarking tool as defined in claim 4 wherein said acute angle is between 1 and 10 degrees.

6. The log debarking tool as defined in claim 1 wherein said cutting means comprises a removable bit having a sharpened edge.

7. The log debarking tool as defined in claim 6 wherein said bit further comprises:

a generally rectangular body having a cutting edge and a spaced apart bottom edge;

an integral flange adapted to be inserted into a slot in said frame; and wherein said bottom edge is adapted to be inserted into a channel in said frame.

8. A log debarking tool for rotary debarking machines, comprising:

a rigid, generally arcuate frame having an arbor adapted to be coupled to a ring rotor of said rotary debarking machine, said arcuate frame having a longitudinal axis;

an arcuate, elongated leading edge defined on said frame for first contacting a log moving into said machine and moving said frame radially outwardly;

a spaced apart exiting edge defined on said frame opposite said leading edge in non-parallel relation thereto, said exiting edge being angularly defined relative to said longitudinal axis to facilitate the gradual inward radial movement of said tool as said log exits said rotor; and, a replaceable cutting bit adapted to contact and debark logs.

9. The log debarking tool as defined in claim 8 wherein said frame comprises a longitudinal axis, and said exiting edge defines an acute angle relative to said longitudinal axis.

10. The log debarking tool as defined in claim 9 wherein said exiting edge facilitates the gradual inward radial movement of said tool as said log exits said rotor.

11. The log debarking tool as defined in claim 9 wherein said acute angle is between 1 and 10 degrees.

12. The log debarking tool as defined in claim 11 wherein said cutting bit comprises a spaced apart bottom edge adapted to be inserted into a channel in said frame and an integral flange adapted to be inserted into a slot in said frame.

13. A log debarking tool for rotary debarking machines, comprising:

frame means for mounting log engaging cutting means, said cutting means disposed upon an end of said frame means for contacting and debarking a log;

arbor means for coupling said frame means to a ring rotor of said rotary debarking machine;

leading edge means defined on said frame means for first threadably contacting a log moving into said machine and moving said frame radially outwardly; and, exiting edge means defined on said frame means opposite said leading edge means for gradually threadably contacting said log as it axially withdraws from said machine for gradually moving said tool radially inwardly when said log exits said ring rotor, and for gradually moving the tool radially outwardly when a log moves backwards into the ring rotor.

14. The log debarking tool as defined in claim 13 wherein said frame means defines a longitudinal axis, said exiting edge means being angularly defined relative to said longitudinal axis at an acute angle.

15. The log debarking tool as defined in claim 14 wherein said leading edge means is angled away from said exiting edge means, and said leading edge means defines an acute angle relative to said longitudinal axis.

16. The log debarking tool as defined in claim 15 wherein said exiting means edge comprises an elongated arcuate edge adapted to climb said log to move said frame means radially inwardly.

17. The log debarking tool as defined in claim 16 wherein said angle is between 1 and 20 degrees.

* * * * *